United States Patent [19]

Ferraro

[11] Patent Number: 4,546,215

[45] Date of Patent: Oct. 8, 1985

[54] DETACHABLE EARMUFFS FOR HEADSETS

[76] Inventor: Michael V. Ferraro, 1048 W. Oakdale, Chicago, Ill. 60657

[21] Appl. No.: 539,800

[22] Filed: Oct. 7, 1983

[51] Int. Cl.[4] ..... H04R 1/02

[52] U.S. Cl. ..... 179/156 R; 179/156 A; 179/182 R; 2/209

[58] Field of Search ..... 179/156 R, 156 A, 178, 179/182 R, 182 A, 184; 2/209

[56] References Cited

U.S. PATENT DOCUMENTS

| | | | |
|---|---|---|---|
| 2,403,418 | 7/1946 | Volkmann | 179/182 R |
| 2,442,825 | 6/1948 | Rabushka | 2/209 |
| 2,447,470 | 8/1948 | Valentine | 179/182 R |
| 2,468,721 | 4/1949 | Volkmann | 179/182 R |
| 2,812,517 | 11/1957 | Bogart | 2/209 |
| 3,098,121 | 7/1963 | Wadsworth | 179/156 R |
| 4,065,645 | 12/1977 | Warner | 179/156 R |
| 4,243,851 | 1/1981 | Forney | 179/184 |
| 4,456,797 | 6/1984 | Olsen | 179/156 R |

FOREIGN PATENT DOCUMENTS

| | | | |
|---|---|---|---|
| 667442 | 10/1929 | France | 179/182 |
| 796004 | 3/1936 | France | 2/209 |

*Primary Examiner*—Gene Z. Rubinson
*Assistant Examiner*—L. C. Schroeder
*Attorney, Agent, or Firm*—Hill, Van Santen, Steadman & Simpson

[57] ABSTRACT

A detachable earmuff has an entrance separation which is normally biased closed and which is resiliently flexibly openable for receiving a headband of a headset for retaining the earmuff in covering relation to a users ear and an earphone held to the users ear by means of the headband. For biasing the entrance separation, overlapping parts of a frame structure extend inwardly from the outer end of the entrance separation. In one embodiment the earmuff frame may comprise a generally flat split plastic ring. In another embodiment the earmuff frame may comprise a resilient wireform which may be constructed in one piece.

21 Claims, 6 Drawing Figures

DETACHABLE EARMUFFS FOR HEADSETS

This invention relates to earmuffs and is more particularly concerned with earmuffs which are especially adapted for use with headsets of the kind commonly worn in connection with small portable radios.

Small portable radios which can be easily carried on a users person while perambulatory and which have a lightweight headset connected thereto, are quite popular. The earphones for such headsets are generally mounted in small size pads which fit fairly snuggly in or on the outer ear. This leaves the pinna and lobe of the outer ear exposed. In cold whether the external ear is therefore liable to frostbite. Ordinary earmuffs cannot be accommodated because of the headband.

It is to the alleviation of this problem that the present invention is directed.

An important object of the invention is to provide a new and improved earmuff which is especially adapted for use with a headset.

To this end, the present invention provides a detachable earmuff for use with a headset, and comprising an earmuff body adapted to cover a users ear and an earphone held to the ear by means of a headband, resilient frame means in assembly with said body, the assembly having an entrance separation extending inwardly from a perimeter to a headband clearance located substantially inwardly from the perimeter, and the frame means providing structure along the entrance separation normally biasing the entrance separation closed, but adapted to be resiliently flexed for opening the entrance separation for passage therethrough of the headband when mounting the earmuff on or removing the earmuff from the headset.

Other objects, features and advantages of the invention will be readily apparent from the following description of preferred embodiments thereof, taken in conjunction with the accompanying drawing, although variations and modifications may be effected without departing from the spirit and scope of the novel concepts of the disclosure, and in which.

Figure 2:
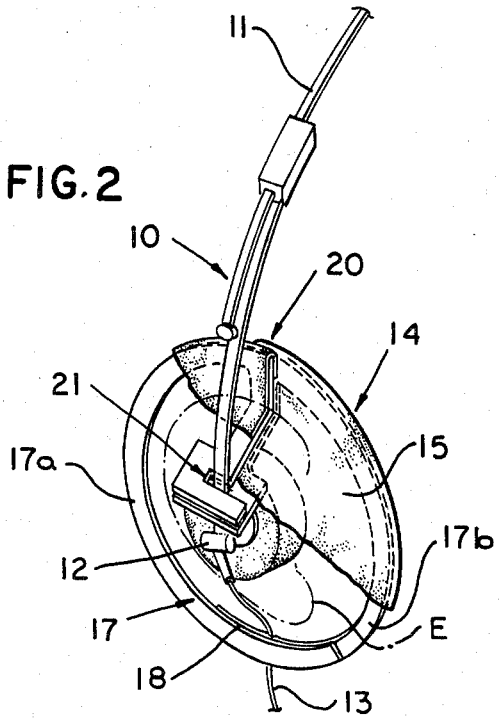
FIG. 2 is an enlarged perspective view of one of the earmuffs and the associated earphone and headset elements.
Figure 1:
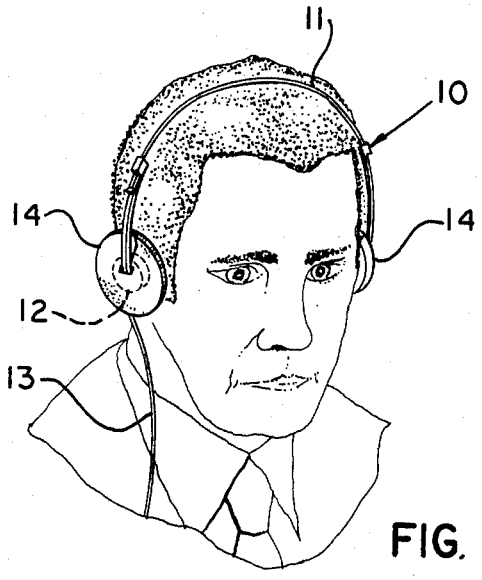
FIG. 1 is an illustrative view showing a headset equipped with earmuffs pursuant to the present invention.
Figure 3:
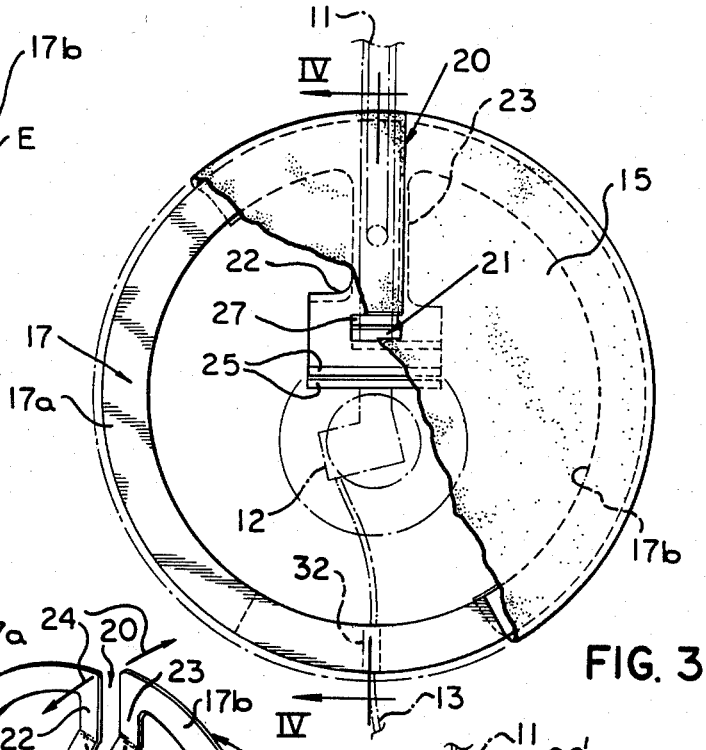
FIG. 3 is an outerside elevational view of the earmuff.

In FIG. 1 is shown a headset 10 of the type which is adapted to be worn by an ambulatory person and having a resilient headband 11 carrying at its ends padded earphones 12 (only one of which is shown) and which are connected by means of an electrical lead 13 to a small radio (not shown) adapted to be carried on the person of the user as is common practice with this type of radio equipment. Earmuffs 14 embodying the present invention, and each of which may be of substantially identical construction, are mounted on the headband over the padded earphones 12.

In a preferred embodiment, each of the earmuffs 14 comprises a muff body 15 adapted to cover a users ear E and the associated earphone 12 which is held to the ear by means of the headband 11. A resilient frame 17 is engaged about a perimeter defined by the body 15. The body 15 may comprise any flexible heat retaining material which may be woven fabric or a non-woven fabric, thin sheet sponge rubber, or the like. The frame 17 is desirably constructed of resiliently flexible self-sustaining flexible material and should be of sufficient rigidity to hold the muff firmly but comfortably in place on and about the users ear E while being sufficiently resiliently flexible for the intended purpose.

In a desirable form, the frame 17 comprises a generally annular narrow flat band of plastic material which is resistant to deformation in its plane but may be resiliently flexed transversely to its plane. For manufacturing convenience, the generally ring-shaped frame 17 may be constructed in two halves 17*a* and 17*b* which are lapped at a joined 18 and fixedly secured together so that, in effect, a unitary frame structure is provided. The muff body 15 may be secured to the frame 17 in any suitable manner such as by wrapping a margin 19 about and securing it adhesively to the frame, as best visualized in FIG. 4.

Figure 5:
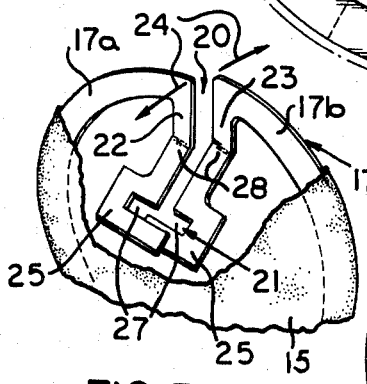
FIG. 5 is a fragmentary illustrative view showing how the entrance separation of the muff is adapted to be flexed open.

In order to enable assembly or disassembly of the muff 14 with respect to the headset 10, the frame 17 with the body 15 attached thereto provides an entrance separation 20 inwardly from the perimeter of the muff to a headband clearance hole 21. The frame 17 has means along the entrance separation normally resiliently biased toward closing of the entrance separation but adapted to be resiliently flexed for receiving the muff 14 on or removing the muff from the headband. For this purpose, free ends of the frame sections 17*a* and 17*b* are arranged to overlap one another and are normally bias toward lapping relation to one another. Further defining the entrance separation 20 are arm projections from the lapping frame section terminals comprising an arm 22 on the frame section 17*a* and an arm 23 on the frame section 17*b*. The arms 22 and 23 are generally lappingly cooperative but are separable by flexing of the terminals of the frame section 17*a* and 17*b* apart as shown in FIG. 5. Therein directional arrows 24 represent digitally applied separating force applied to flex the arms 22 and 23 apart for opening the entrance separation to provide an entrance gap extending inwardly from the perimeter of the muff to the headband clearance 21 located substantially inwardly from the perimeter, and through which the associated arm of the headband 11 is adapted to be received by relative sliding maneuver.

Since the headband 11 has width, each of the arms 22 and 23 is provided with a distal terminal portion 25 provided with a complementary slot 27 for accommodating the headband and for retaining the muff in a loosely stable position relative to the headband. As will be apparent the slots 27 open generally toward one another, and the overall length of the combined slot in the closed condition of the entrance separation is sufficient to accommodate the full width of the headband arm extending through the clearance opening 21 defined by the cooperatively related slots 27.

Figure 4:
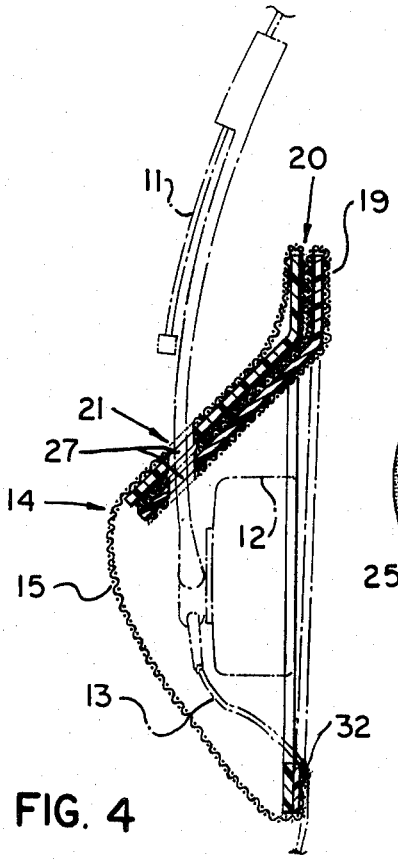
FIG. 4 is a vertical sectional detail view taken substantially along the line IV—IV of FIG. 3.

To assure that the muff 14 will engage the temple area about the users ear E, the arms 22 and 23 are turned outwardly along bend lines 28 adjacent to the associated frame terminals, so that the major lengths of the arms 22 and 23 to and including the slotted terminals 25 extend obliquely outwardly from the plane of the frame 17 into generally overlying relation to the associated earphone 12, as best in FIG. 4. To assist in holding the muff 14 firmly against the head of the user about the ear E, the slots 27 are offset with respect to one another, wherein the slot 27 of the outermost of the arms, herein the arm 22 is offset to be closer to the frame section 17*a* than the slot 27 in the underlying arm 23. Nevertheless the slots 27 are in alignment so that the arm of the headband 11 extending downwardly through the aligned slots 27 will cooperate with the aligned and preferably chamfered edges defining the slots to bias the muff 14 toward the users head. In the assembled relationship of the muff 14 to the headband 10 in each instance, the muff not only provides a closed heat retaining chamber within an ear-receiving pocket, but also is firmly but comfortably biased toward the users head to ensure protection against hostile ambient temperature.

Figure 6:
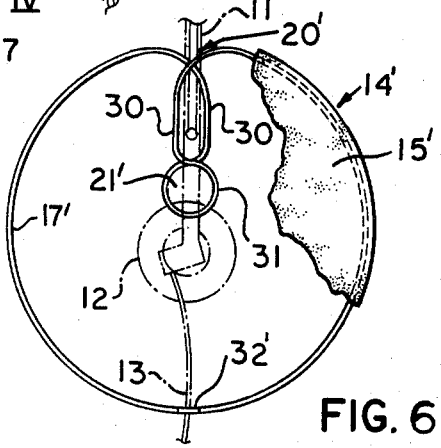
FIG. 6 is an outerside elevational view of a modification of the muff structure.

If preferred, the muff 14' (FIG. 6) may comprise a heat retaining body 15' supported on a frame 17' formed from a one piece of spring wire. In this arrangement the entrance separation 20 is provided by overlapping arm extensions 30 of the wireform frame and which are joined at their inner ends in a loop 31 which provides the headband clearance hole 21'. Although the arms 30 are connected by the loop 31, the size of the loop and the relative flexibility of the arm portions of the frame 17' are such that a sufficient gap is openable to provide the entrance separation for receiving the headband 11 through the separation and into the opening 21' wherein the headband will be retained by the resilient closing bias of the arms 30.

When the muffs 14, 14' are not needed for their ear warming function, they may be carried, detached from the headset 10, on a carrying strap for the associated radio or on a similar strap or strap like element on or about the users person and capable of being received through the entrance separation 20 and in the clearance hole 21, by similar maneuver as explained in relation to the headband 11. It will also be appreciated that the fabric of the body 15, at least on its outer surface may be of any preferred color or combinations of color to suit particular tastes.

Although the terminals 25 of the arms 22 and 23 of the frame 17 of the muff 14 are shown as separable, these terminals may be connected together at their adjacent ends, if preferred. In the muff 14', of course, the inner ends of the arms 30 are connected together by the loop 31.

In order to provide clearance passage for the electrical cord 13 leading from the radio to the earphone 12, the muff assembly may be provided diametrically opposite to the entrance 20 with an inwardly facing and radially extending clearance notch 32. The muff 14' may be similarly provided with such a notch identified at 32'.

It will be understood that variations and modifications may be effected without departing from the spirit and scope of the novel concepts of this invention.

I claim as my invention:

1. A detachable earmuff for use with a headset, and comprising:

an earmuff body adapted to cover a users ear and an earphone held to the ear by means of a headband;

resilient frame means in assembly with said body;

said assembly having an entrance separation extending inwardly from a perimeter to a headband clearance located substantially inwardly from said perimeter;

and said frame means providing structure along said entrance separation normally biasing said entrance separation closed, but adapted to be resiliently flexed for opening said entrance separation for passage therethrough of said headband when mounting the earmuff on or removing the earmuff from said headset.

2. An earmuff according to claim 1, wherein said frame means comprises a frame ring engaging said body about said perimeter.

3. An earmuff according to claim 2, wherein said frame ring comprises self-sustaining plastic and the ring being in a substantially flat plane.

4. An earmuff according to claim 2, wherein said ring comprises resilient wire.

5. An earmuff according to claim 2, wherein said entrance structure comprises generally radially inwardly extending projection means on said ring.

6. An earmuff according to claim 5, wherein said entrance structure projection means is angled from the plane of the ring to clear the earphone.

7. An earmuff according to claim 2, wherein said body and said biasing structure define an ear-receiving pocket within said frame ring.

8. An earmuff according to claim 2, wherein said body comprises a heat retaining sheet material.

9. An earmuff according to claim 1, wherein said biasing structure comprises overlapping parts of said structure and which are separable by resilient flexing of said frame means for opening said entrance separation.

10. An earmuff according to claim 9, wherein said overlapping biasing structure comprises cooperating slots at the distal ends of said overlapping parts for providing said headband clearance.

11. In combination with a headset having a headband and an earphone adapted to be held to a users ear by the headband:

an earmuff for covering the users ear and the earphone;

said earmuff having an entrance separation extending inward from a perimeter to a headband clearance located substantially inwardly from said perimeter; and biasing means normally biasing said separation closed but being resiliently separable for spreading said separation open to provide an entrance gap from said perimeter to said headband clearance for receiving said headband for retaining the earmuff in place with respect to said headset and the users ear.

12. The combination of claim 11, wherein said biasing means comprises a resilient frame built into the earmuff and separable along said separation by a resilient flexing manuever for opening said entrance gap.

13. A combination according to claim 12, wherein said earmuff comprises a fabric body and said resilient frame comprises a frame ring engaged within said body.

14. A combination according to claim 13, wherein said frame ring comprises self-sustaining plastic and the ring being in a substantially flat plane.

15. A combination according to claim 13, wherein said ring comprises resilient wire.

16. A combination according to claim 11, wherein said biasing means comprises a frame structure having generally radially inwardly extending projection means at opposite sides of said entrance separation, and said projection means being resiliently separable.

17. A combination according to claim 11, wherein said biasing means includes structure for maintaining a headphone accommodating pocket within said earmuff.

18. A combination according to claim 12, wherein said earmuff comprises a fabric body covering said resilient supporting frame.

19. A combination according to claim 18, wherein said frame has means for stabilizing engagement with the headband.

20. An earmuff readily attachable to, but detachable from, a headset having a headband and an earphone attached to an end of the headband and adapted to be held to a users ear by the headband:

said earmuff having a flexible body for covering the users ear and the earphone;

said earmuff body having a reclosable opening and biasing means for normally biasing said opening closed but flexibly separable for releasably receiving said earmuff body over said earphone with said headband projecting therefrom;

and means projecting from a perimeter portion of said earmuff body for releasably engaging about said headband for retaining the earmuff in place relative to the earphone and the headband.

21. An earmuff according to claim 20, wherein said releasably engaging means comprises a device extending from a peripheral frame on said body and said device including separable elements for said engaging about said headband.

* * * * *